US005445092A

United States Patent [19]

Washburn, Jr.

[11] Patent Number: 5,445,092

[45] Date of Patent: Aug. 29, 1995

[54] CROCHET STITCH WHICH SIMULATES A WHIP STITCH

[75] Inventor: John M. Washburn, Jr., West Hartford, Conn.

[73] Assignee: The Merrow Machine Company, Newington, Conn.

[21] Appl. No.: 152,384

[22] Filed: Nov. 16, 1993

[51] Int. Cl.[6] ..... D05B 1/20; D05B 93/00

[52] U.S. Cl. ..... 112/439; 112/162; 112/116

[58] Field of Search ..... 112/116, 162, 268.1, 112/121.2, 269.1, 436, 433, 437, 439; 66/3, 193, 85, 118; 139/383 B, 431, 432

[56] References Cited

U.S. PATENT DOCUMENTS

| | | | |
|---|---|---|---|
| 420,191 | 1/1890 | Fefel | 112/162 |
| 455,190 | 6/1891 | Fefel | 112/162 |
| 476,455 | 6/1892 | Fefel | 112/459 |
| 582,314 | 5/1897 | Plumley | 112/436 X |
| 681,670 | 9/1901 | Allen | 112/436 |
| 681,671 | 9/1901 | Allen | 112/436 |
| 817,475 | 4/1906 | Durand | 112/436 X |
| 832,740 | 10/1906 | Maier | 112/162 |
| 982,717 | 1/1911 | Grieb | 112/116 |
| 1,020,944 | 3/1912 | Carter | 112/116 |
| 1,125,437 | 1/1915 | Avis | 112/116 |
| 1,602,408 | 10/1926 | Grieb et al. | 112/162 |
| 2,091,760 | 8/1937 | Kelso | 112/433 X |
| 3,090,963 | 5/1963 | Wittman | 112/162 X |

*Primary Examiner*—Clifford D. Crowder
*Assistant Examiner*—Ismael Izaguirre
*Attorney, Agent, or Firm*—Beveridge, DeGrandi, Weilacher & Young

[57] ABSTRACT

Overedge crochet stitching provides a whip stitch appearance on both sides of a fabric. Each stitch has (a) two contiguous legs of thread on the upper surface of the fabric, extending from a needle hole to the edge of the fabric; and (b) two contiguous legs of thread on the lower surface of the fabric, extending from the needle hole to the edge of the fabric. Both legs on the upper surface are bent to form a two strand bight at the edge of the fabric. Both legs on the lower surface extend first through the two strand bight of the preceding stitch and then to a one strand bight which loops around the two strand bight of the current stitch. The method and apparatus involve a threaded needle which carries the thread through the fabric, a hook which pulls thread to the fabric edge above and below the fabric, and a retractable spreader which supports a leg of thread which extends up from the needle hole to the preceding stitch. The hook simultaneously pulls the spreader-supported leg and the needle eye leg of thread to the fabric edge where they are pulled through a one strand bight which was pulled by the hook beneath the fabric during the preceding excursion of the needle.

31 Claims, 3 Drawing Sheets

CROCHET STITCH WHICH SIMULATES A WHIP STITCH

BACKGROUND OF THE INVENTION

The present invention is directed to a stitch, a method of making the stitch, and an apparatus making the stitch.

Overedge stitching is commonly used in the textile industries to prevent fraying and to provide a variety of decorative effects. One such decorative effect is to provide the appearance of a hand-made whip stitch. An example of a crochet stitch for achieving the appearance of a whip stitch on one side of a piece of fabric is shown in FIG. 1. Each apparent leg of the whip stitch is formed of two contiguous legs 50 of a lower loop. These legs are connected together by a bight 52 through which an upper loop extends. The upper loop has a bight 54 and two legs 56. The bight 54 engages the subsequent lower loop at the edge of the fabric. This simulated whip stitch is adequate for situations where only the lower side of the fabric is visible. However, from the vantage point of the upper side of the fabric, it does not have a whip stitch appearance because the legs 56 of the upper loop are non-contiguous and they form a series of V-shaped patterns so that collectively they make a zig-zag pattern in the margin.

According to the present invention, a conventional crochet stitching machine with relatively minor modifications is able to make a stitch which has the appearance of a whip stitch on both the upper and lower margin portions of the fabric This may be performed in various ways, only one example which is disclosed in this specification.

SUMMARY OF THE INVENTION

This invention relates to improved overedge crochet stitching which has the appearance of a whip stitch.

A stitch according to the invention is describable in terms of the elements which extend from a needle hole. From this perspective, the stitch has a first loop of thread with a bight and two legs. The bight is at the edge of the fabric. Both legs of the first loop extend from the bight forwardly along the edge of the fabric. Bends are formed at the forward ends of these legs of the first loop, and two legs extend from these bends to the needle hole. A second loop of thread has a bight at the edge of the fabric near the bight of the first loop, a first leg extending to the needle hole on a first side of the fabric, and a second leg which extends forwardly along the edge of the fabric. A third loop of the thread has a bight at the edge of the fabric, a first leg extending on the first side of the fabric to the needle hole, and a second leg which extends to the second leg of a second loop of a substantially identical subsequent stitch. The bights of the second and third loops are substantially contiguous and they are linked to the bends of a substantially identical subsequent stitch. This link extends through the bight of the first loop. Preferably, the second leg of the third loop includes a fourth loop which is linked to the bight of the first loop and continues to the second leg of the second loop of a substantially identical subsequent stitch. The two legs which extend from the bends to the needle hole are mutually parallel and adjacent, and they lie at an acute angle relative to the fabric edge. Similarly, the first leg of the second loop and the first leg of the third loop are mutually parallel and adjacent, and they lie at an acute angle relative to the fabric edge.

Alternatively, the stitch can be described in terms of the portions which are serially disposed along the length of the thread. In this respect, the invention involves a plurality of series-connected stitches, each of which has a first leg extending along the edge of the fabric, a second bight at the rear end of the first leg, a second leg extending on the first side of the fabric from the second bight to a needle hole, and a third leg which extends through the fabric at the needle hole. A fourth leg extends on the second side of the fabric from the needle hole to the edge of the fabric where it is formed into a first bend near the forward end of the first leg. This first bend is linked to a bight at the rear end of the first leg of the substantially identical preceding stitch. A fifth leg extends from the first bend rearwardly along the edge of the fabric. A first bight is located at the rear end of the fifth leg, and a sixth leg extends forwardly along the edge of the fabric from the first bight. A second bend is formed at the forward end of the sixth leg, and this second bend is linked to the bight at the rear end of the first leg of a substantially identical preceding stitch. A seventh leg is located on the second side of the fabric and it extends from the second bend to the needle hole. An eighth leg extends through the fabric at the needle hole. A ninth leg extends from the needle hole to the edge of the fabric where the thread is formed into a third bight. The third bight extends to the first leg of a substantially identical subsequent stitch. The second and third bights are linked to the first and second bends of a substantially identical subsequent stitch. Preferably, a fourth bight extends from the third bight to the first leg of a substantially identical subsequent stitch; the second and ninth legs are mutually parallel and adjacent at an acute angle to the fabric edge, and the fourth and seventh legs are mutually parallel and adjacent at an acute angle to the fabric edge.

The invention also involves a method which is especially adapted to form stitches according to the invention. According to the inventive method, a first loop of thread has a bight at the fabric edge and two legs which extend from the bight to the needle hole on the second side of the fabric. The thread extends from these legs through the needle hole to provide two projecting legs which extend from the first side of the fabric. The projecting legs of thread are pulled on the first side of the fabric to form second and third loops, and these loops are pulled through the first loop. A needle penetrates the fabric to carry the thread to the second side of the fabric. The needle thread on the second side of the fabric is pulled to form a further loop which becomes the first loop of a substantially identical subsequent stitch. This further loop is pulled through the second and third loop. This series of steps is repeated successively to form a plurality of stitches. Preferably, the pulling steps are performed with a latch tool which moves between the first and second sides of the fabric; and, a retractable spreader is used to facilitate engagement by the hook of the thread extending from a preceding stitch. The spreader holds the thread up until the hook extends beneath it, prior to the retracting-/hooking/pulling movement of the hook.

The invention also has apparatus aspects. In this regard, the apparatus includes means for forming a first loop of thread which has a bight at the fabric edge and two legs which extend on the second side of the fabric from the bight to a needle hole in the fabric. The thread extends from said legs through the needle hole to provide two projecting legs which extend from the first side of the fabric. Means are provided for pulling the legs of thread on the first side of the fabric to form second and third loops, and these loops are pulled through the first loop. A threaded needle is provided to penetrate the fabric and to carry the thread to the second side of the fabric. Means are provided for pulling the thread on the needle on the second side of the fabric to form a further loop which becomes the first loop of a substantially identical subsequent stitch. This further loop is pulled through the second and third loops to complete the stitch. A preferred pulling means is a laterally movable latch hook associated with a retractable spreader. The spreader holds the thread from a preceding stitch away from the first side of the fabric until the hook passes under the thread, before it hooks and pulls it.

DETAILED DESCRIPTION

Figure 1:
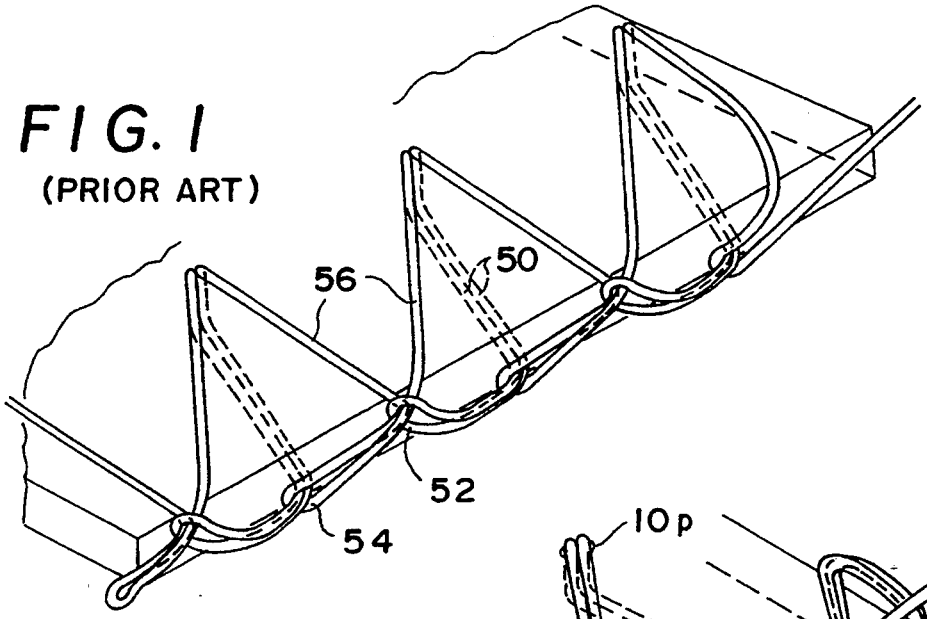
FIG. 1 (PRIOR ART)
FIG. 1 is a line diagram showing a crochet stitch which is known in the prior art and has the appearance of a whip stitch on only one side of the fabric.
Figure 2:
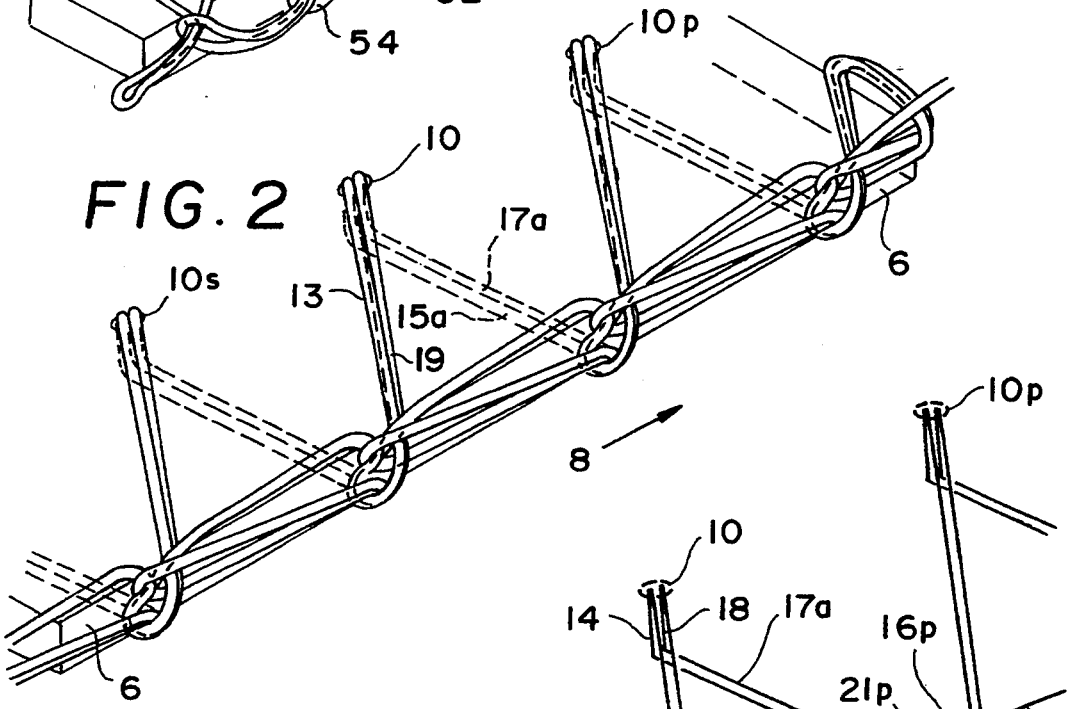
FIG. 2 is a view of a crochet stitch according to the invention in which both sides of the fabric have the appearance of a whip stitch.

As shown in FIG. 2, stitching according to the invention is formed in the margin area of the fabric, between the edge of the fabric and a line defined by the needle holes 10p, 10, 10s. The stitches are identical. The edge of the fabric 6 is shown with exaggerated thickness, and the arrow 8 indicates a forward direction, i.e. the direction the fabric travels when it is fed by the sewing machine.

This description will refer primarily to the stitch associated with needle hole 10. Corresponding elements of the preceding stitch are identified by like reference numerals ending in a "p," and corresponding elements of the subsequent stitch have reference numerals with an "s" suffix.

The stitch from needle hole 10 has contiguous thread segments or legs 13 and 19 which simulate a whip stitch on the first or upper surface of the fabric, and contiguous thread segments or legs 15*a* and 17*a* which simulate a whip stitch on the second or lower surface of the fabric. These pairs of legs lie at acute angles to and on opposite sides of a plane which extends through the needle hole 10 and which is perpendicular to both the plane of the fabric and the edge of the fabric.

Figure 3:
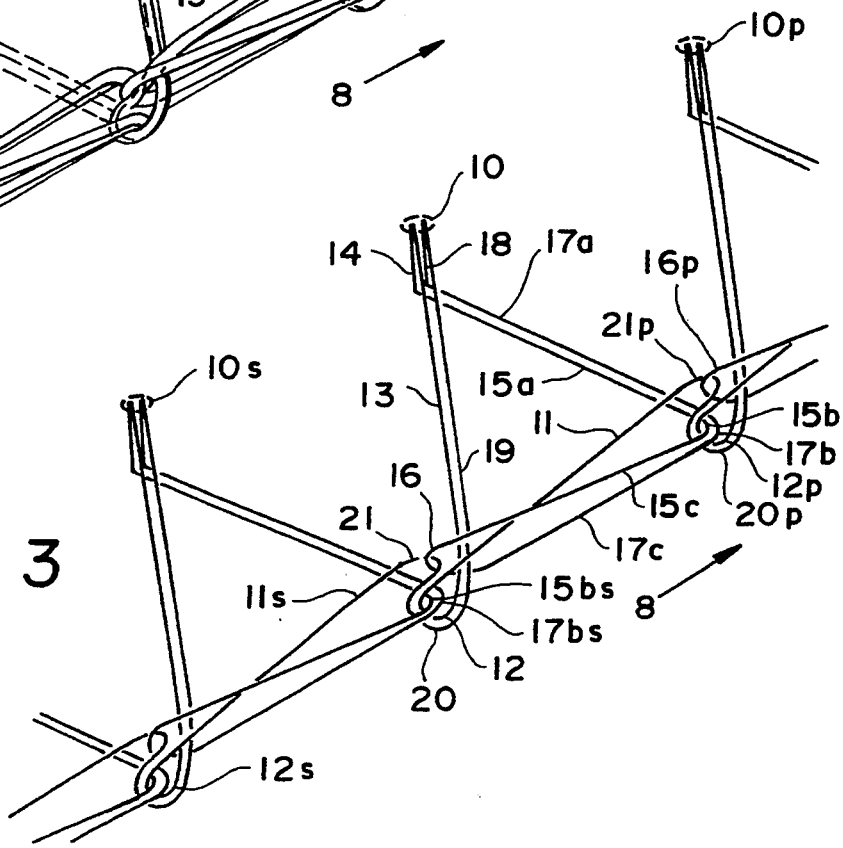
FIG. 3 is a line diagram showing the thread segments in the stitch of FIG. 2.

Each stitch may be described by following along the length the thread, segment-by-segment. As shown in FIG. 3, there is a first leg 11 which extends along the edge of the fabric, a bight 12 at the rear end of the first leg 11, a second leg 13 located on a first side of the fabric (the upper side when the fabric is at the illustrated orientation) and extending from the bight 12 to the needle hole 10, and a third leg 14 which extends through the fabric 2 at the needle hole. Continuing, the thread has a fourth leg 15*a* on the second side of the fabric (the lower side of the illustrated orientation), extending from the needle hole 10 to the edge 6 where it is formed into a first bend 15*b* near the forward end of the leg 11. This bend 15*b* is linked to the bights 12*p* and 20*p* of a substantially identical preceding stitch. A fifth leg 15*c* of the thread extends from the first bend rearwardly along the edge of the fabric. At the rear end of this leg 15*c*, there is a first bight 16. A sixth leg 17*c* extends from the first bight 16 forwardly along the edge of the fabric to a second bend 17*b* which is formed at the forward end of the sixth leg. This second bend 17*b* is linked to the bight 12*p* and 20*p* of the preceding stitch. A seventh leg 17*a* is located on the lower side of the fabric, and it extends from the second bend 17*b* to the needle hole 10. An eighth leg 18 extends up through the fabric at the needle hole 10, and a ninth leg 19 on the upper side of the fabric extends from the needle hole 10 to the edge 6 of the fabric where the thread is formed into a third bight 20. The thread extends from the third bight 20 to a fourth bight 21 and thence to the first leg 11*s* of a substantially identical subsequent stitch. Thus, the second and third bights 12 and 20 form a two-strand bight which is linked to the first and second bends 15*bs*, 17*bs* of the substantially identical subsequent stitch. The first bight 16 is looped entirely around the two-strand bight 12, 20. The second leg 13 and ninth leg 19 are contiguous, parallel and adjacent, and they simulate a whip stitch on the upper surface of the fabric. Similarly, the fourth leg 15*a* and seventh leg 17*a* are contiguous, parallel and adjacent to simulate a whip stitch on the lower surface of the fabric. The second and ninth legs 13, 19 lie at an acute angle relative to the fabric edge; and, the fourth and seventh legs 15*a*, 17*a* lie at an opposite acute angle relative to the fabric edge.

The stitch can alternatively be described by using the needle hole 10 as an origination point. From this perspective, each stitch has parallel contiguous first and second legs 13 and 19 which are on the upper surface of the fabric and extend from the needle hole 10 to the edge of the fabric. At the fabric edge, these legs 13, 19 are both bent to form a two-strand bight 12, 20. A lower loop has two parallel legs 15 and 17 which are direct continuations of the legs 13 and 19. Portions 15*a* and 17*a* of these legs lie beneath the fabric, and they extend from the needle hole 10 to the edge of the fabric where they are bent at 15*b* and 17*b*. They then extend through the two-strand bight 12*p*, 20*p* of the preceding stitch. Thereafter, portions 15*c* and 17*c* of the legs of the lower loop extend along the fabric edge to a point where they join to form a second bight 16. This bight loops entirely around the two-strand bight 12, 20. A leg 11 extends forwardly from bight 12 along the fabric edge directly to the bight 21*p* and then to second leg 20*p* of the two-strand bight of the preceding stitch. A rear leg extends rearwardly from bight 20 to form a bight 21 which leads to the first leg 11*s* of the subsequent stitch.

The method and apparatus for forming the stitch are shown in FIGS. 4–10. The machine elements shown in these illustrations include a vertically reciprocating needle 30, a hook 32 which is provided with a latch 34 and which travels back and forth around the edge of the fabric from an upper position shown in FIG. 4 where the hook is poised to engage the needle thread above the fabric to a lower position shown in FIG. 8 where the hook engages the needle thread below the fabric. The machine has a spreader 36 which oscillates in a plane which is parallel to the feed carrier. Conventional mechanisms are used for driving the needle, the hook, and the spreader. The spreader is mounted on a carrier which is driven off the upper shaft of a Style 18E sewing machine manufactured and sold by the assignee of the present invention, Merrow Machine Company, Newington, Ct.

Figure 4:
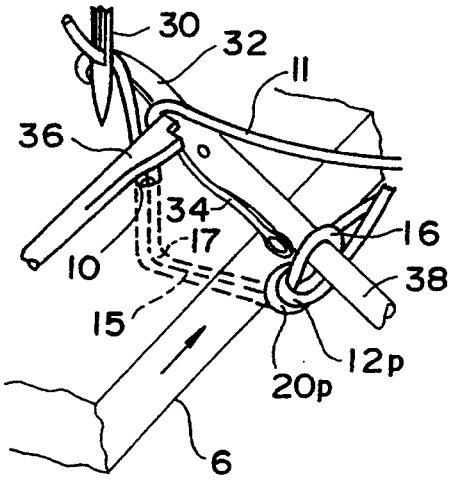
FIGS. 4–10 show an apparatus for forming a stitch according to the invention, and the steps of the preferred method used to form the stitch.

At the point in time shown in FIG. 4, the needle 30 is at its uppermost position and is starting its downward movement. The spreader 36 is stationary and retracted. The fabric is moving forwardly. A loop formed during the previous excursion of the needle has legs 15 and 17 which extend under the fabric from the needle hole 10 to the fabric edge 6. The bight 16 of this loop is looped around the shank 38 of the hook 32. The two-strand bight 12*p*, 20*p* of the preceding stitch is looped entirely around the bight 16.

Figure 5:
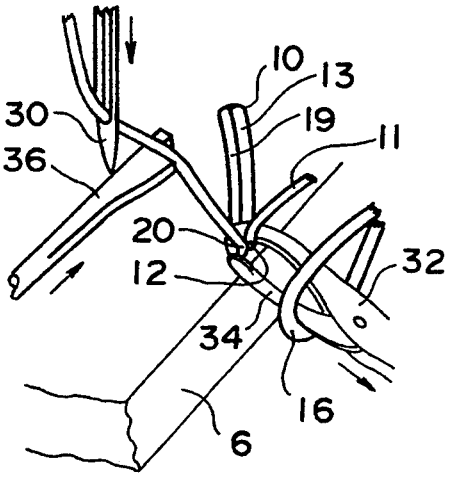

In FIG. 5, the fabric feed has stopped, the needle 30 has commenced its downward travel, and the spreader 36 is moving in a forward direction, passing by the needle. The hook has pulled the legs of the thread which projected on the upper side of the fabric, and this pulling action has formed the bights 12 and 20 of the second and third loops of the stitch.

Figure 6:
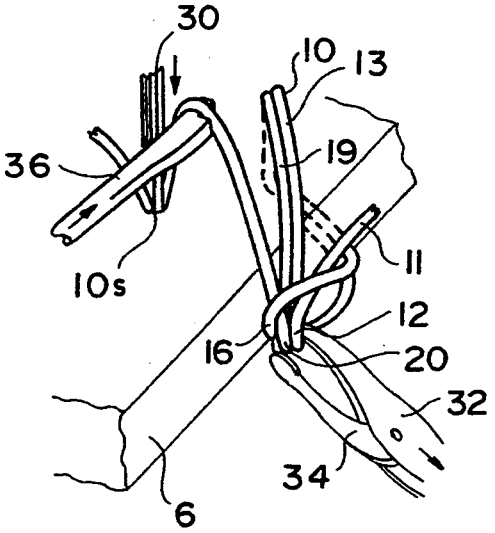
Figure 7:
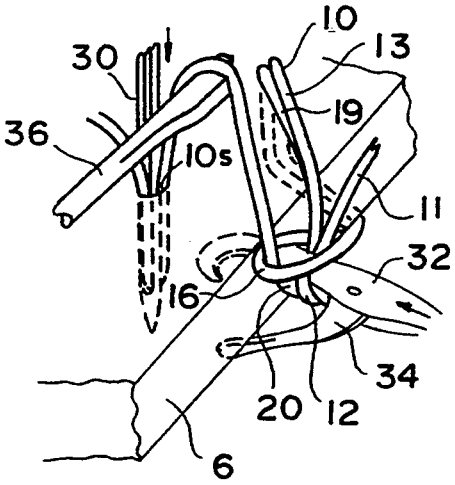
Figure 8:
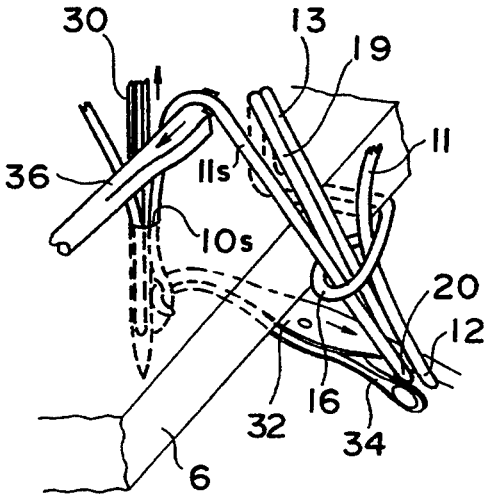

The hook 32 moves to the edge of the fabric, bringing with it the bights 12 and 20. During this movement, the latch 34 is closed by the loop 16. Continued movement of the hook pulls the loops 12 and 20 through the loop 16 as shown in FIG. 6. At this instant, the needle point is in the fabric, the spreader 36 is advancing past the needle, and the hook 32 is retracted and moving down. Further travel of the needle carries the needle thread below the fabric as shown in FIG. 7. At this point in time, the spreader 36 has stopped in its forwardmost advance position and the hook 32 is moving under the fabric toward the needle. This inward movement of the hook 32 causes the bights 12 and 20 to slide outwardly relative to the hook, thus opening the hook latch 34 to the position shown in FIG. 8. At this instant, the needle 30 has just started its upward movement and the spreader 36 has started to move rearwardly. The hook 32 has engaged the needle thread, and it is commencing its outward travel toward the edge of the fabric. The thread pulled by the hook will become the first loop of a substantially identical subsequent stitch.

Figure 9:
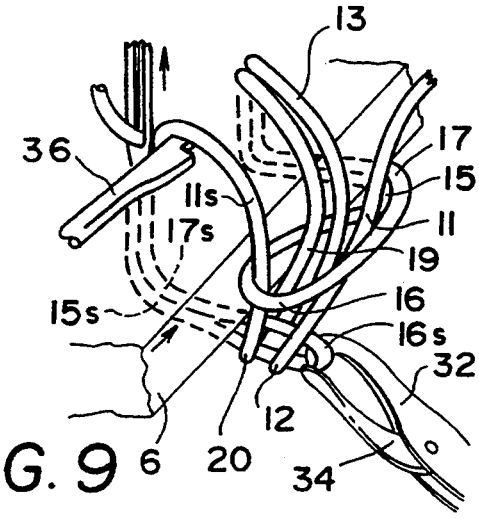

When the hook 32 reaches its point of maximum retraction shown in FIG. 9, the needle point is at the fabric and moving up, the forward feed of the fabric is commenced, and the spreader is continuing to retract. The retraction of the hook has closed the latch 34 and pulled the loop 16*s* through the bights 12 and 20. These bights have slipped off of the closed latch hook.

Figure 10:
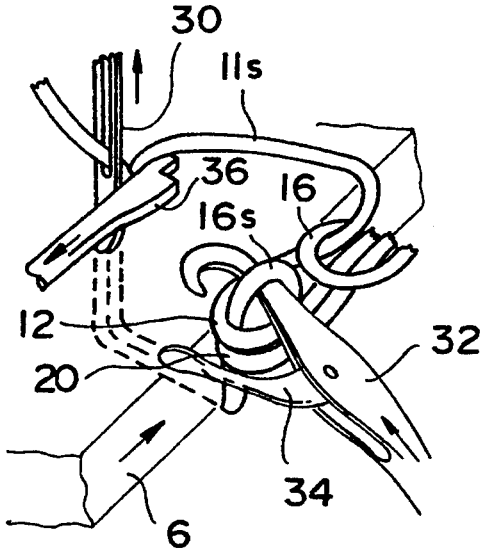

The hook 32 then moves inwardly above the upper surface of the fabric as shown in FIG. 10. The spreader is continuing to retract, the fabric is continuing its forward movement, and the needle is continuing its upward movement above the fabric. Subsequently, the hook will move in to the position shown in FIG. 4, causing the bight 16*s* to open the latch 34 and slip onto the shank of the hook.

Thus, the method and apparatus of the invention form a first loop of thread which has its bight 16 at the fabric edge and two legs with contiguous portions 15*a* and 17*a* which extend on the underside of the fabric to the needle hole 10. The thread further extends from the legs 15*a*, 17*a* up through the needle hole 10 to provide two projecting legs which extend from the first side of the fabric, i.e., the upper side as shown in the drawings. The spreader prevents the thread segment 11 which extends from falling onto the upper surface of the fabric, thus assuring that the hook will pass under this segment 11 and will be able to engage it to form the bight 12 as shown in FIG. 5.

From the foregoing, persons familiar with sewing machine technology will recognize that the invention provides a relatively uncomplicated but highly effective method and apparatus for forming crochet stitching which simulates handmade whip stitching. The stitch itself is novel and attractive and it satisfies a need which has existed in the industry for performing such stitching for utilitarian and decorative purposes.

Persons familiar with the art will also realize that the invention made be practiced in various ways other than those specifically described in this specification. Therefore, it is emphasized that the invention is not limited only to the disclosed embodiment but is embracing of variations thereto and improvements thereof which fall within the spirit of the following claims.

I claim:

1. An overedge crochet stitch for a fabric having a first side, a second side and an edge, a plurality of stitches formed along the fabric edge by a length of thread which penetrates the fabric at needle holes, each said stitch and a stitch which is subsequent to said stitch both comprising, a first loop of thread having a bight at the edge of the fabric and two legs, both of said legs extending from the bight forwardly along the edge of the fabric;

two bends at respective forward ends of said legs of the first loop;

two legs which extend from respective bends to the needle hole;

a second loop of thread having a bight at the edge of the fabric near the bight of the first loop, a first leg extending on a first side of the fabric to the needle hole, and a second leg extending forwardly along the edge of the fabric;

a third loop of thread having a bight which is substantially contiguous with the bight of the second loop, a first leg extending on the first side of the fabric to the needle hole and a second leg which extends to the second leg of a second loop of said stitch which is subsequent to said stitch, said bights of the second and third loops both being linked to said bends of a substantially identical subsequent stitch, one of said bights of the second and third loops extending through the bight of the first loop.

2. An overedge crochet stitch according to claim 1, wherein said second leg of the third loop includes a fourth loop which is linked to the bight of the first loop and connects to the second leg of the second loop of said stitch which is subsequent to said stitch.

3. An overedge crochet stitch according to claim 1 wherein the two legs which extend from said bends to the needle hole are mutually parallel and adjacent.

4. An overedge crochet stitch according to claim 3 wherein the two legs which extend from said bends to the needle hole lie at an acute angle relative to the fabric edge.

5. An overedge crochet stitch according to claim 1 wherein the first leg of the second loop and the first leg of the third loop are mutually parallel and adjacent.

6. An overedge crochet stitch according to claim 5 wherein the first leg of the second loop and the first leg of the third loop lie at an acute angle relative to the fabric edge.

7. Overedge crochet stitching for a piece of fabric having a plurality of stitches extending along its margin, said fabric having a first side, a second side and an edge, said stitches being formed of a continuous length of thread which penetrates the fabric at a series of needle holes, each said stitch and a subsequent said stitch including the following thread elements in sequence:

a first leg which extends along the edge of the fabric, a second bight at the rear end of the first leg, a second leg extending on the first side of the fabric from the second bight to a needle hole, a third leg extending through the fabric at the needle hole, a fourth leg extending on the second side of the fabric from the needle hole to the edge of the fabric where it is formed into a first bend near the forward end of the first leg, said first bend being linked to a said second bight of said stitch which is subsequent to said stitch, a fifth leg extending from the first bend rearwardly along the edge of the fabric, a first bight at the rear end of the fifth leg, a sixth leg extending forwardly along the edge of the fabric from the first bight, a second bend at the forward end of the sixth leg, said second bend being linked to a said second bight of said stitch which is subsequent to said stitch, a seventh leg on the second side of the fabric and extending from the second bend to the needle hole, an eighth leg extending through the fabric at the needle hole, and a ninth leg on the first side of the fabric extending from the needle hole to the edge of the fabric where the thread is formed into a third bight, which extends to a said first leg of said stitch which is subsequent to said stitch, said second and third bights being linked to the first and second bends of said stitch which is subsequent to said stitch.

8. Overedge crochet stitching according to claim 7 having a fourth bight which extends from the third bight to the first leg of said stitch which is subsequent to said stitch.

9. Overedge crochet stitching according to claim 7 wherein the second and ninth legs are mutually parallel and adjacent, and the fourth and seventh legs are mutually parallel and adjacent.

10. Overedge crochet stitch according to claim 9 wherein the second and ninth legs lie at an acute angle relative to the fabric edge.

11. Overedge crochet stitch according to claim 9 wherein the fourth and seventh legs lie at an acute angle relative to the fabric edge.

12. A method of making an overedge crochet stitching on a piece of fabric having a first side, a second side and an edge, said method including the following steps:

(a) forming a first loop of thread which has a bight at the fabric edge and two legs with portions which extend on the second side of the fabric to a needle hole, said thread further extending through the needle hole to provide two projecting legs which extend from the first side of the fabric, one of said projecting legs extending to the eye of a needle;

(b) pulling said projecting legs of thread on the first side of the fabric to form second and third loops, and pulling said second and third loops through said first loop;

(c) penetrating the fabric with said needle to carry said thread to the second side of the fabric;

(d) pulling the thread on the needle on the second side of the fabric to form a further loop which is the first loop of a substantially identical subsequent stitch, and pulling the further loop through the second and third loops; and, (e) successively repeating steps (b) through (d) to form a plurality of stitches.

13. The method according to claim 12 wherein the hook has a shank which extends through said first loop when the thread is pulled in step (b) to form the second and third loops.

14. The method according to claim 12 wherein the pulling steps are performed by engaging the thread with a moving hook, said hook being moved between steps (b) and (d) from the first side of the fabric to the second side of the fabric.

15. The method according to claim 14 including the steps of using a latch to close the hook during the pulling step (b), and opening said latch before the pulling step (d).

16. The method according to claim 14 wherein the hook has a shank which extends through said second and third loops when the thread is pulled in step (d) to form the further loop.

17. The method according to claim 14 wherein the two legs which project from the first side of the fabric in step (a) include a leg which extends to the needle and a leg which extends from the needle to a preceding stitch, said method including the step of holding the leg which extends from the needle hole to a preceding stitch to space the leg which extends from the needle hole to a preceding stitch from the first side of the fabric to facilitate engagement by said hook of the leg which extends from the needle hole to a substantially identical preceding stitch.

18. The method according to claim 17 wherein the pulling steps are performed by a hook and the holding step is performed at least until said hook passes between the first side of the fabric and the leg which extends from the needle hole to a substantially identical preceding stitch.

19. The method according to claim 17 wherein the holding step is performed by a spreader which is in engagement with the thread when the needle penetrates the fabric.

20. The method according to claim 19 including the step of moving the spreader forwardly to an extended position.

21. The method according to claim 19 including the step of moving the spreader rearwardly to a retracted position after said hook moves to the second side of the fabric.

22. The method according to claim 12 wherein the thread extends from the needle hole to the fabric edge at an acute angle to the fabric edge.

23. Apparatus for making an overedge crochet stitch on a piece of fabric having a first side, a second side and an edge, comprising, (a) means for forming a first loop of thread which has a bight at the fabric edge and two legs with portions which extend on the second side of the fabric from the bight to a needle hole in the fabric, said thread further extending through the needle hole to provide two projecting legs which extend from the first side of the fabric, (b) a needle having an eye to which one of said projecting legs extends, (c) means for both i pulling said legs of thread on the first side of the fabric to form second and third loops and (ii) pulling said second and third loops through said first loop, (d) said needle being movable to penetrate the fabric to carry said thread to the second side of the fabric, (e) means for pulling the thread on the needle on the second side of the fabric to form a further loop which is the first loop of a substantially identical subsequent stitch, and for pulling the further loop through the second and third loops.

24. Apparatus according to claim 23 wherein the pulling means (c) and (e) includes a hook, said hook being movable from the first side of the fabric to the second side of the fabric.

25. Apparatus according to claim 24 wherein the hook has a latch which is closed when it pulls the second and third loops through said first loop.

26. Apparatus according to claim 24 wherein the hook has a shank which extends through said first loop when the thread is pulled to form the second and third loops.

27. Apparatus according to claim 24 wherein the hook has a shank which extends through said second and third loops when the thread is pulled to form the further loop.

28. Apparatus according to claim 23 wherein said two legs which project from the first side of the fabric include a leg which extends from the needle hole to the needle and a leg which extends from the needle hole to a substantially identical preceding stitch, said apparatus having spreader means for spreading, from the first side of the fabric, the leg which extends from the needle hole to a substantially identical preceding stitch to facilitate engagement by said hook of the leg which extends from the needle hole to a substantially identical preceding stitch.

29. Apparatus according to claim 28 wherein the means (b) and (e) includes a hook, and the spreader means is operable at least until said hook passes between the first side of the fabric and the leg which extends from the needle hole to a substantially identical preceding stitch.

30. Apparatus according to claim 28 wherein the spreader means is in engagement with the thread when the needle penetrates the fabric.

31. Apparatus according to claim 28 wherein the spreader means is movable between a retracted position and an extended position.

* * * * *